US006543330B2

(12) United States Patent
Breuer et al.

(10) Patent No.: US 6,543,330 B2
(45) Date of Patent: Apr. 8, 2003

(54) GUN FOR FIRING ELECTRICALLY-IGNITABLE CARTRIDGES CONTAINING ELECTRONIC COMPONENTS

(75) Inventors: Heinz Günter Breuer, Duisburg (DE); Hans Hülsewis, Duisburg (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 09/982,513

(22) Filed: Oct. 22, 2001

(65) Prior Publication Data

US 2002/0046643 A1 Apr. 25, 2002

(30) Foreign Application Priority Data

Oct. 20, 2000 (DE) ..... 100 52 049

(51) Int. Cl.[7] ..... F41A 19/69
(52) U.S. Cl. ..... 89/28.05; 42/84; 89/28.1
(58) Field of Search ..... 89/28.05, 28.1; 42/84; 102/472

(56) References Cited

U.S. PATENT DOCUMENTS

| | | | | |
|---|---|---|---|---|
| 309,262 A | * | 12/1884 | Thompson | 42/84 |
| 2,868,081 A | | 1/1959 | Grover | |
| 3,777,387 A | * | 12/1973 | Ritchey | 42/84 |
| 3,814,017 A | | 6/1974 | Backstein et al. | |
| 4,206,683 A | * | 6/1980 | Ringelhan | 89/28.1 |
| 4,263,836 A | * | 4/1981 | Koine | 227/10 |
| 4,271,453 A | * | 6/1981 | Yajima et al. | 102/202.2 |
| 5,044,278 A | * | 9/1991 | Campbell | 102/202.8 |
| 5,220,126 A | * | 6/1993 | Borgwarth et al. | 102/472 |
| 5,235,129 A | * | 8/1993 | Corney | 102/472 |
| 5,625,972 A | * | 5/1997 | King et al. | 102/472 |
| 6,006,645 A | * | 12/1999 | Breuer et al. | 89/17 |
| 6,085,629 A | | 7/2000 | Thiesen et al. | |
| 6,186,041 B1 | * | 2/2001 | Menges | 89/17 |
| 6,247,411 B1 | * | 6/2001 | Vornfett | 102/469 |

FOREIGN PATENT DOCUMENTS

| | | |
|---|---|---|
| CH | 256259 | 8/1948 |
| DE | 736564 C | 6/1943 |
| DE | 2059665 A | 6/1972 |
| DE | 19716227 A | 10/1998 |

* cited by examiner

*Primary Examiner*—Charles T. Jordan
*Assistant Examiner*—John W. Zerr
(74) *Attorney, Agent, or Firm*—Venable; Norman N. Kunitz

(57) ABSTRACT

A gun having a wedge-type breech block and a barrel seated in a cradle for firing electrically-ignitable cartridges containing electronic components, and an ignition contact (4) for connection to an external current source, and a signal contact (5) for connecting the electronic components to an external electronic control device are disposed on the cartridge base (3). To ensure reliable ignition of the cartridge, and transmission of data from the cartridge, an axially displaceable ignition and signal-transmission unit (8) is provided in the breech block, and includes a housing (11) having two parallel, axial guides (12, 13), and two spring-loaded, needle-shaped contact devices (16, 17) arranged to be displaced inside the respective guides such that, in the extended position of the unit (8), the first contact device (16) is pressed against the cartridge ignition contact (4) and the second contact device (17) is pressed against the cartridge signal contact (5).

8 Claims, 2 Drawing Sheets

GUN FOR FIRING ELECTRICALLY-IGNITABLE CARTRIDGES CONTAINING ELECTRONIC COMPONENTS

CROSS REFERENCE TO RELATED APPLICATION

This application claims the priority of German patent Application No. 100 52 049.9 filed Oct. 20, 2000, which is incorporated herein by reference.

BACKGROUND OF THE INVENTION

The invention relates to a gun for firing electrically-ignitable cartridges that contain electronic components, and in which an ignition contact is disposed on the cartridge bottom or base for producing a connection to an external current source, and a signal contact is disposed on the cartridge bottom or base for connecting the electronic components to an external electronic control and evaluation device.

Large-caliber guns for firing electrically-ignitable cartridges, as are used in combat tanks, for example, usually include a gun barrel that is seated in a cradle, and on which a breech ring having a wedge-type block that can be displaced transversely to the bore length is mounted on the breech end of the barrel. Disposed in the wedge-type breech block is an ignition transmission unit, which can be displaced axially, counter to the pressure of a spring, from a retracted position into an extended position by a breech-block unit, and is electrically connected via an ignition line to a contact device disposed on the stationary cradle. The current source that generates the electrical ignition signals is also connected to the contact device.

DE-OS 20 59 665, corresponding to U.S. Pat. No. 3,814,017, discloses a gun for firing electrically-ignitable cartridges that additionally contain electronic components, which serve in ascertaining the powder temperature of the respective cartridge. The data collected by the electronic components are subsequently transmitted to the cartridge of the same line used to transmit the ignition signals, then transmitted further to a fire-control calculator and used to correct the directional and/or ignition signals ascertained by the fire-control calculator.

The use of the same electrical line for transmitting data and ignition siganals poses a safety problem, because an undesired firing of the cartridge cannot be sufficiently reliably precluded.

DE 197 16 227, corresponding to U.S. Pat. No. 6,085,629, further discloses a gun of the type mentioned at the outset, with which electrically-ignitable cartridges can be fired. The cartridge bases or bottoms are provided with a central ignition contact for connecting to an external current source, and a signal contact, which is separate from the ignition contact, for connecting to a fire-control calculator. This publication, however, provides no further details about the breech-block-side construction of the corresponding gun.

SUMMARY OF THE INVENTION

It is the object of the invention to provide a gun with a wedge-type breech block of the type mentioned at the outset, in which the cartridge can be ignited and data can be transmitted from the cartridge to an external unit in a simple, safe manner.

This object is accomplished according to the invention by a gun for firing electrically-ignitable cartridges that contain electronic components, and in which an ignition contact is disposed on the cartridge bottom for producing a connection to an external current source, and a signal contact is disposed on the cartridge bottom for connecting the electronic components to an external electronic control and evaluation device, which gun includes a barrel that is seated in a cradle, and to which a breech ring is secured at its breech end, and a wedge-type breech block that is mounted in the breech ring for displacement transverse to the longitudinal axis or length of the bore of the gun barrel. An ignition and signal-transmission unit is mounted in the breech block for displacement in the axial direction of the barrel, counter to the force of a spring, from a retracted position into an extended position by a breech-block unit. The ignition and signal-transmission unit comprises a housing that includes two parallel, axially extending guides, and respective spring-loaded, needle-shaped contact devices seated inside the axial guides for displacement such that, in the extended position of the ignition and signal-transmission unit when the breech block is in a locked position, the first contact device is pressed against the ignition contact of a cartridge and the second contact device is pressed against the signal contact of a cartridge. Moreover, on a side facing away from a cartridge and toward the breech-block unit, the two needle-shaped contact devices are supported by respective compression springs against the housing of the ignition and signal-transmission unit, or a part that is connected to the housing part for movement therewith. Further, particularly advantageous, embodiments of the invention additionally are disclosed and described.

The invention is essentially based on the concept of providing an ignition and signal-transmission unit instead of an ignition-transmission unit, with a housing part that preferably comprises an insulating material and has two parallel, axial guides provided in the unit. Two spring-loaded, needle-shaped contact devices are disposed to be displaced inside the axial guides such that, in the extended position of the ignition and signal-transmission unit, the first contact device is pressed against the ignition contact and the second contact device is pressed against the signal contact of the cartridge. On the side facing the breech-block unit, each of the two needle-shaped contact devices are supported by a respective compression spring against the housing part of the ignition and signal-transmission unit, or a part that is connected to the housing part, such that the two contact devices can execute a different equalization stroke in the extended position of the ignition and signal-transmission unit, depending on the arrangement of the ignition and signal contact of the cartridge located in the loading space of the gun barrel.

It has proven advantageous for the two contact devices to be connected by essentially parallel electrical lines to the contact device of the gun that is fixed to the cradle, with the lines being disposed in common, strip-shaped structural groups, at least in partial regions.

The fire-control system or the ignition device can be fixedly connected to the contact devices secured to the cradle. The contacting of the electrical lines with the needle-shaped contact devices is advantageously effected by sliding contacts. In a similar manner, the electrical lines in the transition region between the ignition and signal-transmission unit and the breech wedge, and in the region between the breech wedge and the floor part, and/or between the floor part and the gun cradle, can be connected by way of sliding contacts.

A particular advantage of the invention lies in the fact that the majority of the tanks equipped with conventional guns (e.g., the Leopard 2 combat tank) can easily be retrofitted to fire electrically-ignitable cartridges. No mechanical manipulation of the wedge-type breech block and the breech ring is necessary. Usually, it is only necessary to replace the existing ignition-transmission unit with the ignition and signal-transmission unit according to the invention. The existing breech-block unit can continue to be used for displacing the ignition and signal-transmission unit. The electrical line needed for ignition transmission in conventional guns is replaced by a connection comprising two lines; the existing passageways through the wedge-type breech block and the breech ring can be used for these lines.

The exemplary embodiments illustrated in the figures reveal further details and advantages of the invention.

DETAILED DESCRIPTION OF THE PREFERRED EMBODIMENTS

Figure 1:
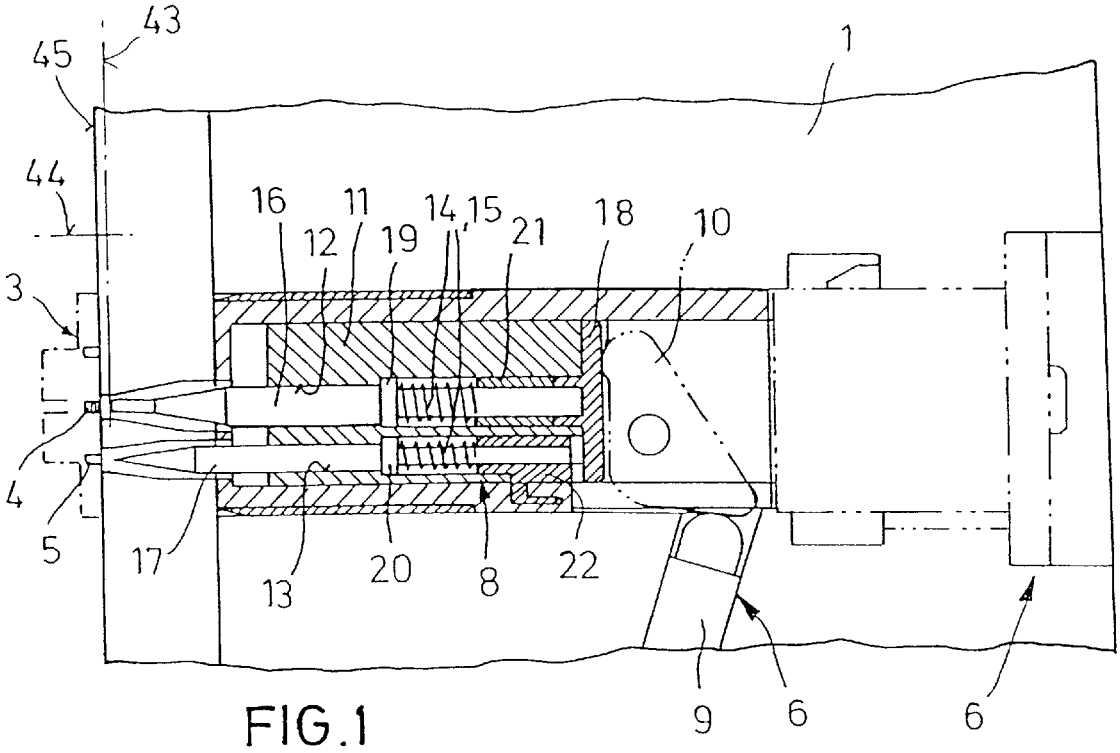
FIG. 1 is a section through an ignition and signal-transmission unit disposed to be axially displaced in a breech wedge, in its retracted position.
Figure 2:
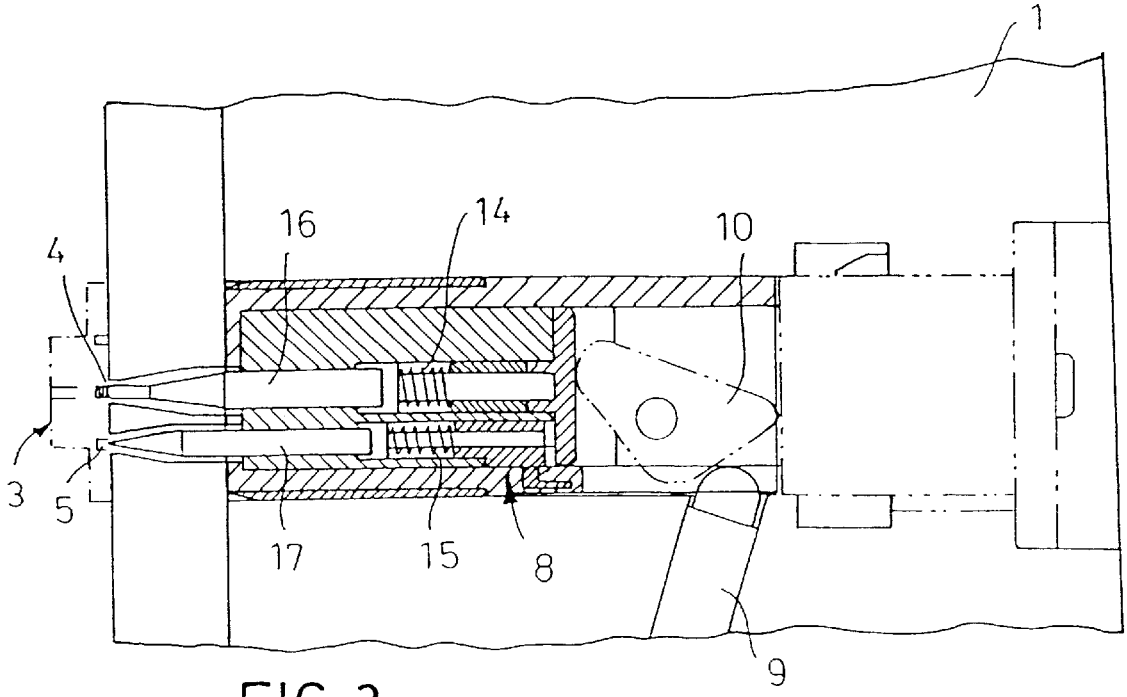
FIG. 2 is a section corresponding to FIG. 1, with the ignition and signal-transmission unit being located in its extended position.

In FIGS. 1 and 2, 1 represents a plan view of a wedge-type breech block that is disposed to be displaced in the breech ring 2 (FIG. 3) of a gun. In FIG. 1, the breech block is open, and in FIG. 2 it is closed. Reference numeral 3 represents, in a dashed line, the bottom or base a cartridge located in the loading space of the corresponding gun barrel. Disposed on the outside of the cartridge bottom 3 are a central ignition contact 4 and a signal contact 5 extending in annular fashion around the ignition contact 4.

Disposed in the wedge-type breech block 1 is an ignition and signal-transmission unit 8 that can be displaced axially, counter to the pressure of a spring 7, (See FIG. 3) from the retracted position shown in FIG. 1 into the extended position shown in FIG. 2 by a breech-block unit 6. The displacement of the ignition and signal-transmission unit 8 is effected with the aid of a control pin 9 that acts on the ignition and signal-transmission unit 8 via a pivotable deflection lever 10.

The ignition and signal-transmission unit 8 comprises a housing 11 formed of an insulating material, e.g., plastic, which includes two parallel, axial guides 12, 13, inside which two needle-shaped contact devices 16, 17, respectively, are seated to be displaced by respective compression springs 14, 15. The first, central contact device 16 serves in contacting the ignition The two guides 12, 13 of the housing 11 are closed by a lid 18, which is acted upon by the deflection lever 10 to move or laterally displace the unit 8. In addition, the compression springs 14, 15 acting on the needle-shaped contact devices 16, 17 are supported on one side on a collar 19, 20 of the respective contact device 16, 17, and on the other side against sleeve-like sliding contacts 21, 22 that border on the lid 18.

Figure 3:
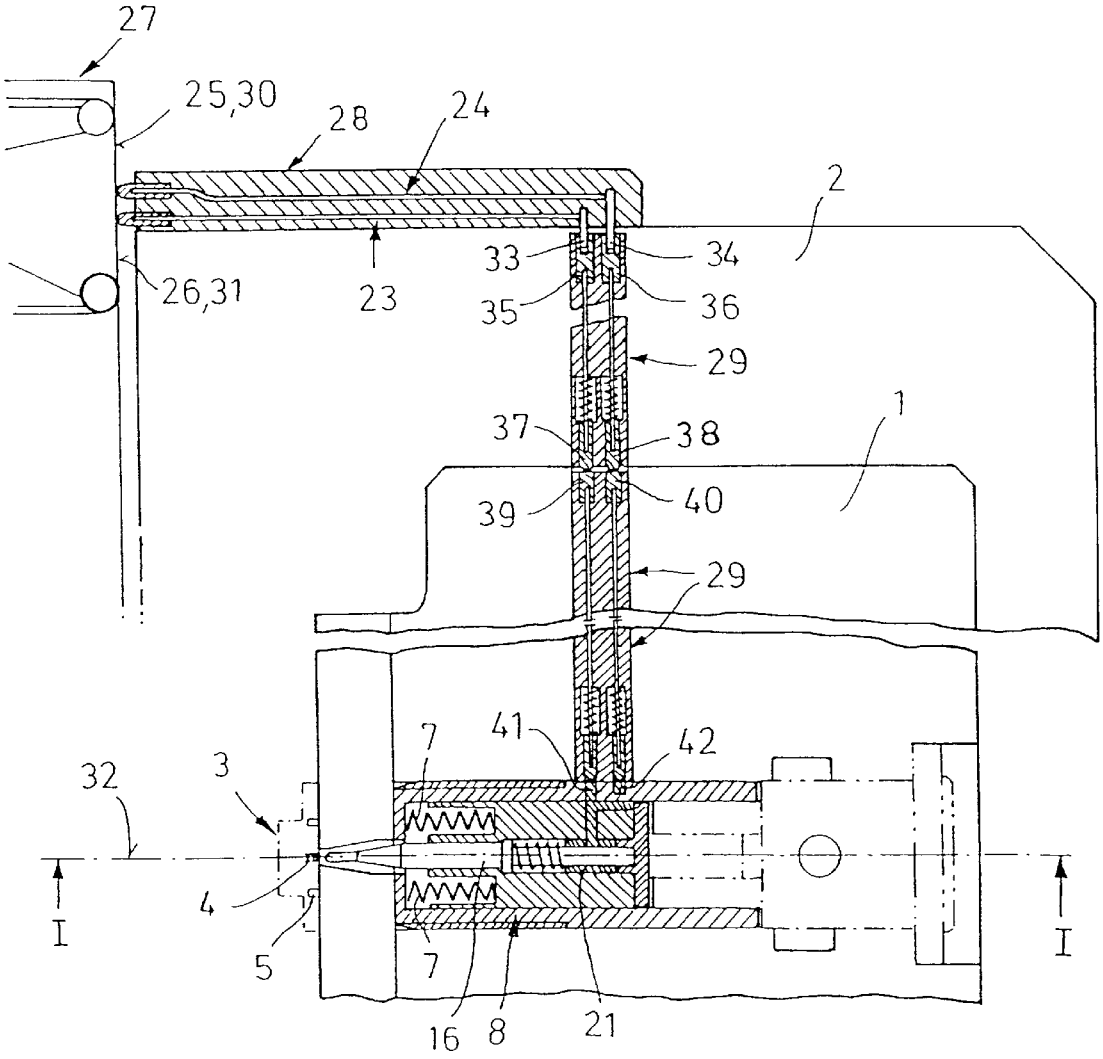
FIG. 3 shows the ignition and signal-transmission unit illustrated in FIGS. 1 and 2, in a position rotated by 90° about the bore length of the corresponding gun barrel.

As can be inferred from FIG. 3, the two contact devices 16, 17 are connected via an ignition line 23 and a signal line 24, which extends parallel to the ignition line, to corresponding contact devices 25, 26 of the cradle 27 of the corresponding gun. The parallel lines 23, 24 are embodied in regions as strip-shaped structural groups 28, 29, and are interrupted by a plurality of contact arrangements. Sliding contacts 30, 31 in the form of leg-leaf springs are mounted to the cradle 27, at the (post-firing) breakaway point from the retractable breech ring 2. In the end position (gun in the firing position), the free legs of the two springs 30, 31 rest against the corresponding contacts of the contact strip 28 disposed laterally on the outside of the breech ring 2 and receiving the two lines.

Inside the breech ring 2 and the wedge-type breech block 1, the two lines 23, 24 extend essentially perpendicular relative to the bore length or axis 32. Two contact pins 33, 34 protrude from the housing of the contact strip 28, and are connected directly to two plug contacts 35, 36 associated with the line segments of the ignition and signal lines inside the breech ring 2.

The transmission of current from the breech ring 2 to the line segments inside the breech block 1 is effected by spring-loaded pressure contacts 37, 38 that are disposed in the breech ring 2 and rest against the corresponding contacts 39, 40 of the breech block 1 when the breech block is in the closed position.

In a similar way, current is transmitted from the line segments extending in the wedge-type breech block 1 to the contacts 41, 42 of the ignition and signal-transmission unit, which are in turn connected to the sleeve-like sliding contacts 21, 22 surrounding the contact devices 16, 17 (FIG. 1).

The function of the invention is as follows. It is assumed that the breech block is initially open (FIGS. 1 and 3). In this case, the ignition line 23 and the signal line 24 are likewise open in the region of the transition between the breech ring 2 and the breech block 1 because of the open position of the breech block 1. The ignition and signal-transmission unit 8 is also located in its retracted position, and the front ends 43 of the contact devices 16, 17 are set back by an offset distance 44 from the stop surface 45 of the breech block 1 at the cartridge bottom 3. It is impossible to fire the loaded cartridge or transmit data under these circumstances.

If the breech block is now closed (FIG. 2), the ignition and signal lines 23, 24 are also closed, which produces an electrical connection between the needle-shaped contact devices 16, 17 and the contact devices 25, 26 at the gun cradle 27. When the breech block is subsequently locked, the control pin 9 is displaced and the deflection lever 10 displaces the ignition and signal-transmission unit 8, with the two needle-shaped contact devices 16, 17, into its extended position. The two contact devices 16, 17 rest against the corresponding contacts 4, 5 of the cartridge bottom 3, with the compression springs 14, 15 assuring a sufficient pressing pressure and individual positioning. The ignition and signal contacts 4, 5 are now electrically connected to the contact device 25, 26 of the gun cradle 27 by the ignition and signal lines 23, 24.

The invention now being fully described, it will be apparent to one of ordinary skill in the art that many changes and modifications can be made thereto without departing from the spirit or scope of the invention as set forth herein.

What is claimed is:

1. A gun for firing electrically-ignitable cartridges that contain electronic components, and in which an ignition contact is disposed on a cartridge bottom for producing a connection to an external current source, and a signal contact is disposed on the cartridge bottom for connecting the electronic components to an external electronic control and evaluation device, said gun including:

a barrel that is seated in a gun cradle;

a breech ring secured to a breech end of the barrel;

a wedge-type breech block mounted in the breech ring for displacement transverse to a longitudinal bore axis of a barrel bore of the gun;

an ignition and signal-transmission unit mounted in the breech block for displacement in an axial direction of the barrel, counter to a force of a spring, from a retracted position into an extended position by a breech-block unit;

said ignition and signal-transmission unit comprising a housing that includes two parallel, axially extending guides, and respective spring-loaded, needle-shaped first and second contact devices seated in said axial guides for displacement such that, in the extended position of the ignition and signal-transmission unit when the breech block is in a locked position, the first contact device is pressed against the ignition contact of a cartridge and the second contact device is pressed against the signal contact of a cartridge; and on a side facing away from a cartridge and toward the breech-block unit, the two needle-shaped contact devices are supported by respective compression springs against one of a housing of the ignition and signal-transmission unit and a part that is connected to the housing for movement therewith.

2. The gun according to claim 1, wherein the two needle-shaped contact devices are connected via two substantially parallel electrical lines to contact devices of the gun that are secured to the cradle.

3. The gun according to claim 2, wherein the contacting of the electrical lines with the needle-shaped contact devices is effected by sliding contacts disposed in the housing.

4. The gun according to claim 3 wherein the electrical lines are interrupted by sliding contacts in a transition region between the ignition and signal-transmission unit and the wedge-type breech block, in a transition region between the wedge-type breech block and the breech ring, and in a transition region between the breech ring and the cradle.

5. The gun according to claim 2, wherein the electrical lines are interrupted by sliding contacts in a transition region between the ignition and signal-transmission unit and the wedge-type breech block, in a transition region between the wedge-type breech block and the breech ring, and in a transition region between the breech ring and the cradle.

6. The gun according to claim 2, wherein the two substantially parallel lines are disposed in common, strip-shaped structural groups, at least in partial regions.

7. The gun according to claim 2, wherein the two substantially parallel lines are guided from the respective needle-shaped contact devices, substantially perpendicular to the bore axis of the barrel, to an outside of the breech ring, and then laterally along a surface of the breech ring to the gun cradle.

8. The gun according to claim 1, wherein the housing of the ignition and signal-transmission unit comprises an electrically-insulating material.

* * * * *